United States Patent [19]

Nesland

[11] Patent Number: 4,676,435

[45] Date of Patent: Jun. 30, 1987

[54] SPRAYER HEAD

[76] Inventor: Nickolas B. Nesland, 46825 - 290 SE., Enumclaw, Wash. 98022

[21] Appl. No.: 845,321

[22] Filed: Apr. 1, 1986

[51] Int. Cl.[4] ..... B05B 15/02

[52] U.S. Cl. ..... 239/112; 137/625.48; 239/119; 239/443; 251/172; 251/900

[58] Field of Search ..... 239/119, 443, 444, 446, 239/436, 541, 113, 112, 106; 251/172, 174, 170, 900; 137/625.25, 625.68, 625.48

[56] References Cited

U.S. PATENT DOCUMENTS

| | | | |
|---|---|---|---|
| 1,304,384 | 5/1919 | Schlatter | 239/446 |
| 2,887,736 | 5/1959 | Barrett | 20/40.5 |
| 3,146,793 | 9/1964 | Boys et al. | 137/625.48 X |
| 3,593,920 | 7/1971 | Watson | 239/119 |
| 3,959,024 | 5/1976 | Kirk et al. | 137/625.68 X |
| 3,985,300 | 10/1976 | Pinney | 239/119 |
| 4,116,386 | 9/1978 | Calder | 239/119 |
| 4,365,563 | 12/1982 | Wu | 110/186 |
| 4,423,741 | 1/1984 | Levy | 137/625.48 X |

*Primary Examiner*—Andres Kashnikow
*Assistant Examiner*—Daniel R. Edelbrock
*Attorney, Agent, or Firm*—Christensen, O'Connor, Johnson & Kindness

[57] ABSTRACT

A sprayer comprising a housing (10) having an internal aperture in which a spool (12) is mounted for translational movement is disclosed. The spool has a nozzle (32) mounted to it. A cavity (30), formed in the spool, is configured to provide a passageway for directing fluid from an inlet (20) in the housing to the nozzle when the sprayer is in a spraying position. The cavity also provides a fluid passageway from the fluid inlet to a fluid outlet (21), which is also formed in the housing. The latter fluid passageway permits a reverse fluid flow through the nozzle. The direction of the reverse fluid flow is opposite to spraying flow direction. Thus, the reverse fluid flow cleans the nozzle by removing matter that clogs the nozzle. A pneumatically actuated, double-acting piston and cylinder assembly is used to move the spool between the spraying position and the cleaning position.

19 Claims, 4 Drawing Figures

SPRAYER HEAD

TECHNICAL FIELD

This invention relates to liquid sprayers and, more particularly, to sprayer heads for liquid sprayers.

BACKGROUND OF THE INVENTION

In the lumber industry it is common to treat logs and milled lumber with certain chemical solutions. For example, logs may be treated with biocidal agents to prevent the development of fungi and bacteria. Additionally, clear or pigmented with water repellent coatings may be applied to milled lumber. The usual method of applying these chemical solutions is to spray them on the logs and lumber to be treated. Because the biocides and coatings applied to the logs are usually caustic and carcinogenic, it is necessary to minimize worker exposure to these materials. Accordingly, when the chemical solutions are to be sprayed on logs and lumber, the items to be sprayed are moved to a restricted access spraying area. During spraying, workers are kept from the vicinity of spraying. After spraying, the vicinity is aired for an extended period of time before workers are allowed to enter the area.

A problem associated with log and lumber spraying is the frequency with which the orifices of sprayer nozzles become clogged. The clogging problem is compounded by the fact that workers cannot enter the spraying area to unclog clogged sprayer nozzle orifices until the expiration of the extended airing period required after spraying stops.

One common type of sprayer head used to spray chemical solutions on logs and lumber includes a spray nozzle diametrically mounted in a cylinder. The cylinder is attached to a handle that is used to manually rotate the cylinder through 180° between a spraying position and a cleaning position. When in the spraying position, the chemical solution is sprayed out an orifice in a conventional manner. When the orifice becomes clogged, the cylinder is rotated to the cleaning position. When in the cleaning position, the chemical solution is forced through the nozzle in the reverse direction, resulting in the cleaning of the nozzle orifice.

While it is theoretically possible to provide a mechanical mechanism for rotating the cylinder of a spray nozzle of the type described above to avoid the need to have a worker manually rotate the cylinder, such mechanisms are impractical because they are undesirably complex and difficult to design. These difficulties arise because of problems associated with the fact that a high rotary torque is required to rotate the cylinder in which the nozzle is mounted.

The present invention is a sprayer head that overcomes the foregoing disadvantages. More specifically, the present invention is directed to providing a sprayer head having a nozzle that is movable between spraying and cleaning positions by an uncomplicated mechanical mechanism that can be remotely actuated. As a result, the sprayer head is ideally suited for use in the lumber industry to spray chemical solutions on logs and finished lumber. Rather than having to air out a spray area in order for workers to be able to enter the area and clean the orifices of spray nozzles as heretofore required, the orifices of nozzles of sprayer heads formed in accordance with the invention can be cleaned without requiring worker access to the spray area.

SUMMARY OF THE INVENTION

In accordance with this invention, a sprayer head having a simple construction and configured for self-cleaning of the sprayer nozzle orifice is provided. The sprayer head includes a housing having a longitudinal aperture, a fluid inlet and a cleaning outlet. A spool, mounted in the longitudinal aperture, is slidably movable between a spraying position and a cleaning position. A longitudinal cavity formed in the spool communicates between three separate orifices formed in the outer surface of the spool—a nozzle orifice, a fluid in orifice and a fluid exit orifice. A spray nozzle is mounted in the cavity adjacent to the nozzle orifice. The cavity is shaped so that when the spool is in the spraying position, the fluid in orifice of the spool is aligned with the fluid inlet of the housing. Thus, the cavity provides a passageway for fluid to flow from the housing fluid inlet to the spray nozzle. When the spool is in the cleaning position, the nozzle orifice and, thus, the outlet end of the nozzle are aligned with the fluid inlet of the housing. Further, the fluid exit orifice of the spool is aligned with the cleaning outlet of the housing. Thus, the cavity provides a passageway for fluid to flow from the housing fluid inlet through the nozzle in the reverse direction to the cleaning outlet. As a result, material that clogs the nozzle orifice is removed when the spool is in the cleaning position. The spool is slid between the spraying and cleaning positions by an uncomplicated reciprocal movement mechanism, such as a pneumatically driven, double-acting piston and cylinder assembly. Since pneumatic actuators of this type and other actuators of a similar nature, i.e., hydraulic and electric reciprocating actuators, are readily controlled by remotely located control mechanisms, the orifices of nozzles of sprayer heads formed in accordance with the invention can be cleaned without requiring workers to enter the area in which spraying takes place.

In accordance with another aspect of this invention, seals are provided for sealing the unused exit orifices of the cavity when the spool is in the spraying and cleaning positions.

In accordance with other aspects of this invention the longitudinal aperture and the spool have square cross-sectional configurations.

In accordance with still other aspects of this invention the fluid inlet and the cleaning outlet of the housing are located in alignment, on opposing sides of the longitudinal aperture.

As will be readily appreciated from the foregoing summary, the invention allows clogging spray nozzles to be unclogged quickly after clogging is discovered, or spray nozzles can be cleaned at regular intervals in order to avoid clogging. In either case, cleaning does not need to wait until the spraying nozzles, no separate cleaning fluid and associated fluid conduits, inlets, outlets, etc., are needed.

BRIEF DESCRIPTION OF THE DRAWINGS

The foregoing and other advantages and features of the present invention will be better understood from the following description of a preferred embodiment of the invention when considered in conjunction with the accompanying drawings wherein.

DETAILED DESCRIPTION OF THE PREFERRED EMBODIMENT

Figure 1:
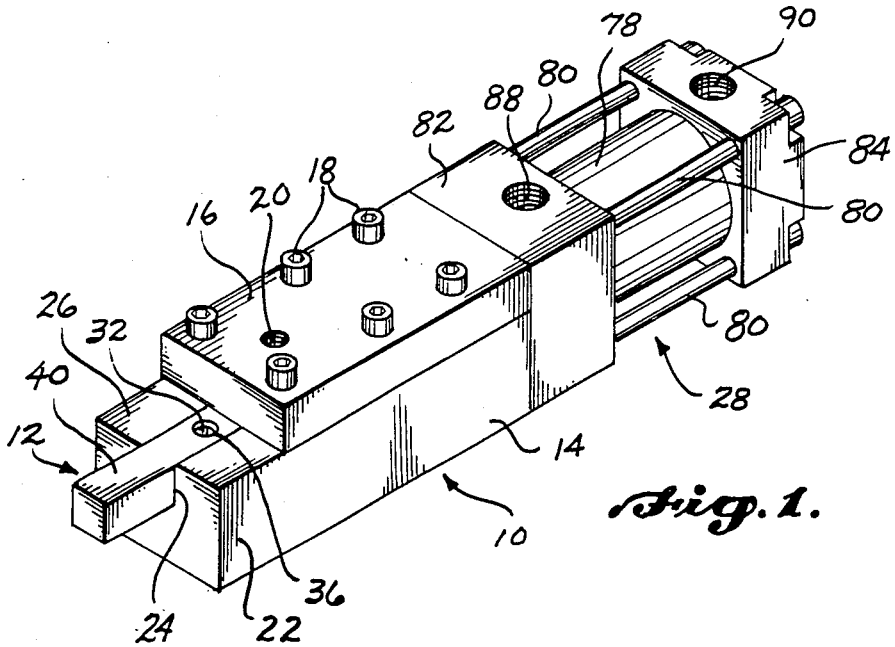
FIG. 1 is an isometric view of a spray head formed in accordance with this invention showing the spool in the spraying position.
Figure 2:
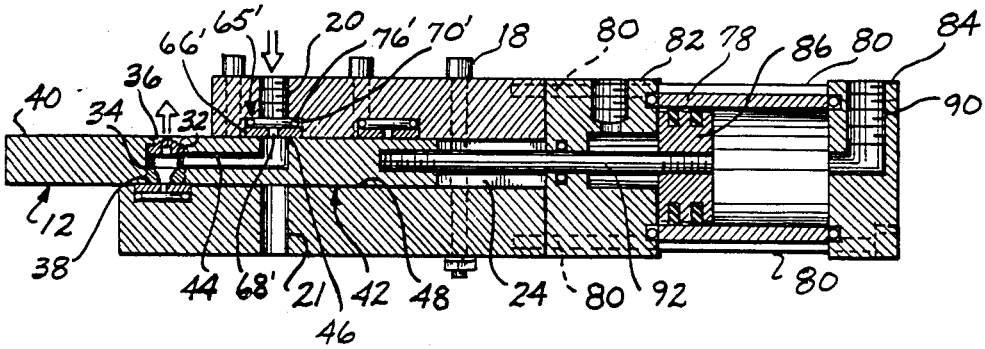
FIG. 2 is a longitudinal cross-sectional view of the spray head of FIG. 1 showing the spool in the spraying position.

With reference to FIGS. 1 and 2, a sprayer formed in accordance with this invention comprises an elongate housing 10 having a longitudinal aperture in which a spool 12 is mounted. As shown in the drawings, the housing may be formed of a base 14 and a top 16 that are held together with a plurality of threaded fasteners 18. The base 14 is slightly longer than the top 16, hence, a front portion 22 of the base protrudes outwardly from beneath the top 16 at one end of the housing. As will be better understood from the following description, this is the spray end of the housing. The base 14 has a longitudinal groove 24 formed in it that communicates with uppermost surface 26 of the base 14 and is covered by the top 16 except in the region where the base protrudes outwardly from beneath the top. The groove 24 has a square cross section and forms the longitudinal aperture in which the spool 12 is mounted. The top 16 includes a fluid inlet 20, suitable for connection to a pressurized fluid source, that communicates with the groove 24. A cleaning outlet 21, formed in the base 14, extends between the bottom 48 of the groove and the bottom surface of the base 14. As shown, the fluid inlet 20 and the cleaning outlet 21 are aligned with one another.

Figure 4:
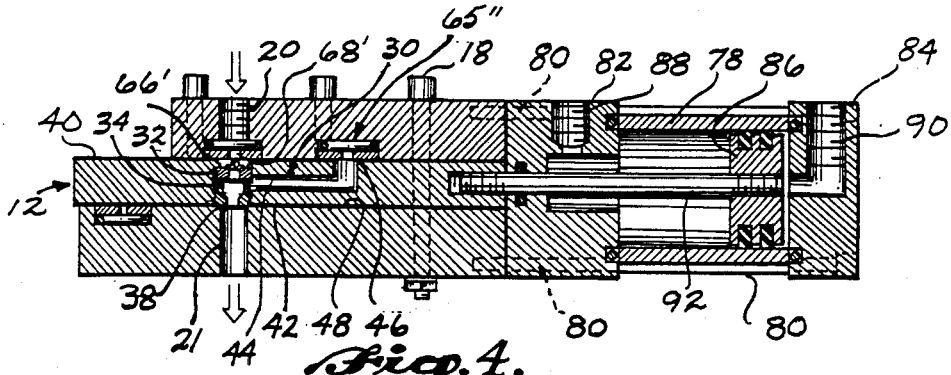

The spool 12 is an elongate, rod-like member having a square cross section that corresponds to the square cross section of the groove 24. The spool 12 slides translationally in the groove 24. Spool movement is controlled by a linear actuator 28 that is mounted on the end of the housing remote from the end from which the base protrudes. The linear actuator 28 is described in detail below. The spool is moved by the linear actuator 28 between a spraying position (FIGS. 1 and 2), and a cleaning position (FIG. 4).

The spool 12 includes a longitudinal cavity 30. The cavity 30 comprises two connected branches, a transverse branch 34 and an L-shaped branch 44. The transverse branch 34 is circular in cross section and extends between a nozzle orifice 36 that is formed in one surface 40 of the spool and a fluid exit orifice formed in the opposite surface 42 of the spool. The nozzle orifice faces the top 16 of the housing and the fluid exit orifice faces the bottom 48 of the groove. The L-shaped branch 44 is connected to the transverse branch and extends along the spool from the midpoint of the first branch to a fluid in orifice 46 that is formed in the same surface 40 of the spool 12 as the nozzle orifice 36.

When the spool 12 is in the spraying position, the fluid inlet 20 formed in the top 16 is aligned with the fluid in orifice 46 of the spool 12. Further, the nozzle orifice 36 is positioned beyond the end of the top, as shown in FIGS. 1 and 2. Thus, the spray head is configured to provide a path for fluid to flow from the fluid inlet 20 to a spray nozzle 32 mounted in the nozzle orifice 36 and be emitted by the nozzle 32. More specifically, fluid enters through the fluid inlet 20 and flows through the fluid in orifice 46 into the L-shaped branch 44 of the cavity 30. The fluid flows from the L-shaped branch 44 into the transverse branch 34 and exits via the spray nozzle 32 mounted in the transverse branch.

Figure 3:
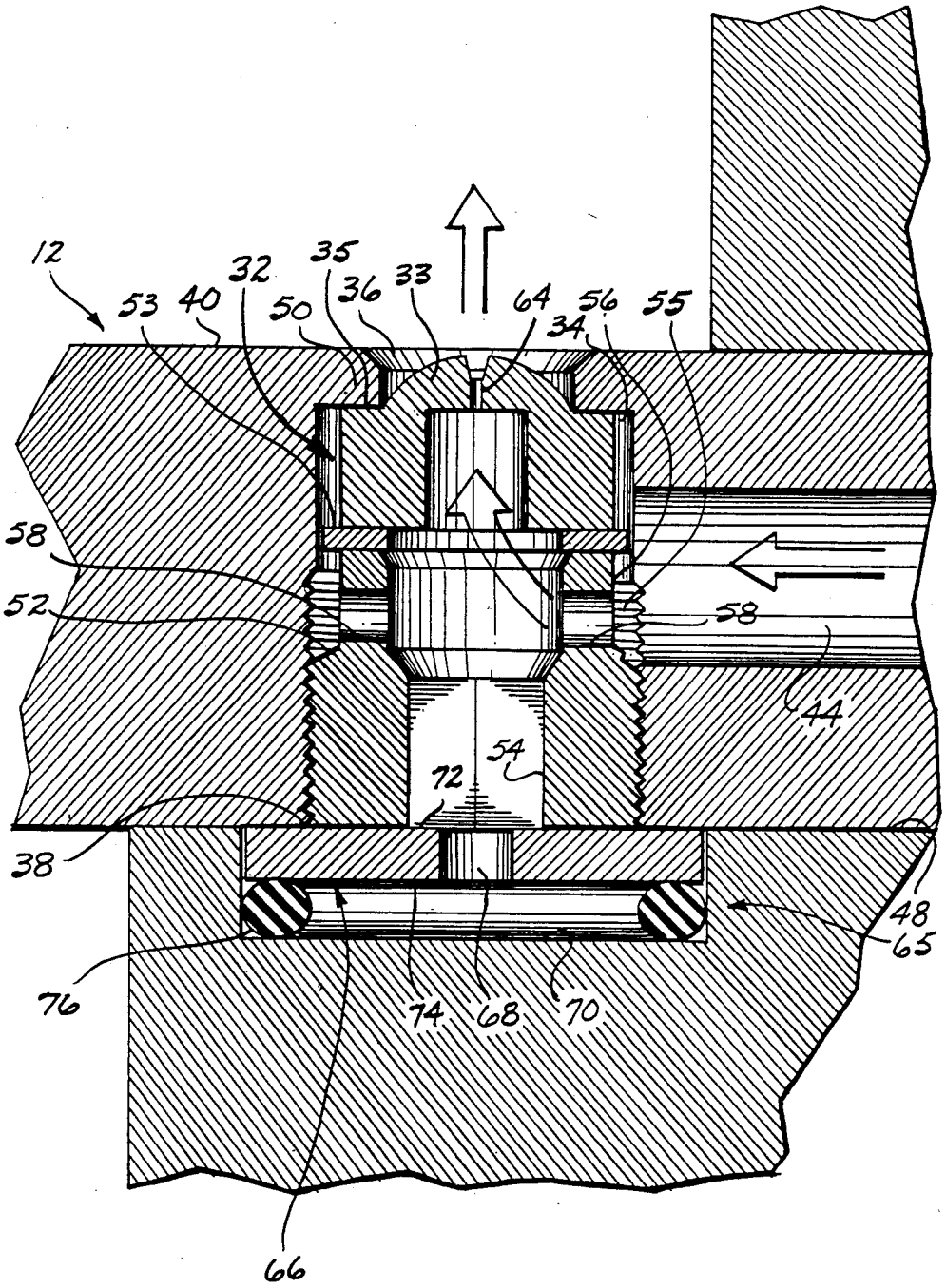
FIG. 3 is enlarged cross-sectional view of the nozzle region of the spray head; and, FIG. 4 is a longitudinal cross-sectional view of the spray head of FIG. 1 showing the spool in the cleaning position.

While various spray nozzles can be used, one suitable nozzle is the Tungsten Carbide Flat Spray Orifice manufactured by Spray Systems, Inc. of Wheaton, Ill. 60187. FIG. 3 is an enlarged view of such a nozzle mounted in the transverse branch 34 of the cavity 30. The illustrated spray nozzle includes an annular-shaped nozzle piece 33 that includes orifice 64 of the nozzle. The nozzle piece 33 includes a shoulder 35 that is seated against the underside of an annular rim 50 that protrudes radially into the transverse branch 34 slightly inwardly from the nozzle orifice 36. The nozzle piece 33 is pressed against the rim 50 by a hollow set screw 52. A washer 53 is interposed between the nozzle piece and the hollow set screw. The hollow set screw 52 is threaded into the transverse branch 34 of the cavity from the fluid exit orifice end of the branch.

The surface 56 of the cylindrical periphery of the set screw adjacent to the washer 53 is smooth and slightly smaller in diameter than the diameter of the transverse branch 34 of the cavity. Further, the smaller diameter surface 56 is aligned with the intersection end of the L-shaped branch 44. Thus, when the spool is in its spraying position, fluid from the L-shaped branch 44 of the cavity 30 flows around an annular-shaped space 55 that is formed between the smaller diameter exterior surface 56 of the set screw 52 and the wall of the transverse branch 34 of the cavity 30. The fluid leaves the annular-shaped space 55 and enters the central opening 54 in the hollow set screw 52 via two transverse spaced-apart holes 58 that extend between the central opening and the smaller diameter surface 56 of the set screw. The direction of spray fluid flow is shown by large arrows in FIG. 3.

As shown best in FIG. 3, when the spool is in its spraying position, the fluid exit orifice 38 is sealed against the bottom surface 48 of the groove to prevent fluid from leaving the nozzle via the central opening in the set screw. The seal is provided by an assembly 65 that comprises a rigid seal plate 66 having the configuration of a conventional flat washer. That is, the seal plate is flat, annular and includes a relatively small central aperture 68. The seal plate 66 has a front surface 72 and a back surface 74 and is sized to completely cover the fluid exit orifice 38. The seal plate 66 fits into a cylindrical recess 70 formed in the bottom surface 48 of the groove 24. An elastic O-ring 76 is mounted in the recess 70 so as to press against the back side 74 of the seal plate 66. The O-ring 76 is sized so that it is in a slightly compressed state when the sprayer head is assembled. Because the seal plate 66 is continuously urged against the spool 12 by the O-ring, the plate creates a seal between the spool and the housing. The central aperture 68 in seal 66 permits some fluid to pass into the recess 70 and apply a pressure against the back side of the seal plate that counterbalances the fluid pressure applied to the sealing side of the seal plate. As will be appreciated by those skilled in the sealing art, the fluid back pressure provided by the hole reduces the pressure requirements of the O-ring. If the hole were absent, the O-ring would have to compensate for the entire fluid pressure created by the spraying fluid.

As shown in FIG. 2, a similar seal assembly 65′ is located in the top 16 at the point where the fluid inlet 20 meets the longitudinal aperture. While the structure of this seal assembly 65′ is substantially identical to the seal assembly 65 just described with reference to FIG. 3, since the fluid inlet passes entirely through the top, no back side pressure is created. More specifically, the seal assembly 65' includes a seal plate 66' and an O-ring 76' fitted within a recess 70' that communicates with the fluid inlet 20. The seal plate 66' and the O-ring 76' are arranged such that the seal plate 66' is continuously urged by the O-ring 76' against the spool to provide a seal between the spool and the housing. Fluid flows through the small central aperture 68' in the seal plate 66'.

When it is necessary to unclog the sprayer nozzle 32 of the sprayer, the actuator 28 is activated to slide the spool from the spraying position to a cleaning position. As shown in FIG. 4, when the spool 12 is in the cleaning position, the transverse branch 34 of the spool cavity is positioned between the fluid inlet 20 and the cleaning outlet 21 of the housing. The L-shaped branch 44 is positioned so that the fluid in orifice 46 is aligned with a third seal assembly located in the top 16 of the housing. The third seal assembly 65'' is substantially identical to the first and second seal assemblies 65 and 65' described above with reference to FIG. 3. The third seal assembly prevents liquid from being emitted from the fluid in orifice 46 when the spool 12 is in the cleaning position.

As shown in FIG. 4, the nozzle can be cleaned by the same fluid that previously was sprayed out the nozzle 32. Alternatively, another fluid could be used if desired. The same fluid can be used because the outlet side of the nozzle 32 is aligned with the fluid inlet 20 when the spool 12 is in its cleaning position. More specifically, when in the cleaning position, fluid flow passes from the fluid inlet 20 in a reverse direction through the nozzle orifice and the central opening 54 in the set screw 52. The fluid then enters the axially aligned cleaning outlet 21 from which it exits the spray head. The central aperture 68' of the seal plate 66' located at the junction of the inlet 20 and nozzle orifice 36 acts to concentrate the reverse fluid flow adjacent the nozzle orifice 64. Thus, a relatively high velocity flow is utilized to remove any clogging material in the nozzle orifice. After cleaning is finished, the spool is returned to the spraying position so that spraying can be resumed.

The preferred actuator 28 for sliding the spool 12 between the spraying position and the cleaning position is a double-acting pneumatic piston and cylinder assembly having a rod that mechanically links the piston to the spool. More particularly, the actuator 28 comprises a cylinder 78 secured by four bolts 80 between a mounting block 82 and an end block 84. The mounting block 82 abuts the actuator end of the housing 10. The bolts 80 extend through the mounting block 82 into the housing to secure the actuator 28 to the housing. A piston 86 is located within the cylinder 78. The piston 86 is forcibly moved within the cylinder when the working medium, e.g., pressurized air, is introduced into the cylinder 78 through either a cleaning port 88 formed in the mounting block 82 or a spraying port 90 formed in the end block 84. The motion of the piston 86 is transferred to the spool 12 by a rod 92 connected between the spool 12 and the piston 86.

Because controls for delivering pressurized air to the ports 88, 90 can be located at a point remote from the nozzle, cleaning of the spray nozzle can be controlled at a safe location remote from the spraying vicinity. As a result, access to the vicinity of a sprayer head formed in accordance with the invention is not needed to clean the nozzle of such a head. Thus, the spraying area does not have to be aired out prior to cleaning of a sprayer head formed in accordance with the invention.

It is to be understood that various changes, substitutions of equivalents and other alterations can be made without departing from the spirit and scope of the invention. For example, translational movement of the spool between the spraying position and the cleaning position can be accomplished by mechanisms other than that described with respect to the preferred embodiment. Other suitable mechanisms include electric solenoid actuators and hydraulic actuators. Further, the cross-sectional shape of the spool could be circular or have some cross-sectional shape other than square. Hence, the invention can be practiced otherwise than as specifically described herein.

The embodiments of the invention in which an exclusive property or privilege is claimed are defined as follows:

1. A sprayer head comprising:

(a) an elongate housing including:

(i) a longitudinal aperture;

(ii) a fluid inlet extending between the exterior of said housing and said longitudinal aperture; and, (iii) a fluid outlet extending between the exterior of said housing and said longitudinal aperture;

(b) a nozzle;

(c) an elongate spool mounted in said longitudinal aperture for translational movement between a spraying position and a cleaning position, said spool including a cavity having a plurality of orifices located on the outer surface of said spool, one of said orifices positioned so as to be aligned with said fluid inlet when said spool is in said spraying position, said nozzle mounted in said cavity so as to spray fluid from another of said orifices, said other orifice positioned so as to be aligned with said fluid inlet when said spool is in said cleaning position, one of said orifices positioned so as to be aligned with said fluid outlet when said spool is in said cleaning position; and, (d) linear actuation means mounted on one end of said housing for moving said spool between said spraying position and said cleaning position.

2. The sprayer head claimed in claim 1, wherein said housing and said spool are configured such that said orifice from which said nozzle sprays fluid is exposed when said spool is in said spraying position.

3. The sprayer head claimed in claim 1, wherein said cavity has three orifices located in the outer surface of said spool, the first orifice positioned so as to be aligned with said fluid inlet when said spool is in said spraying position, said nozzle mounted in said cavity so as to spray from the second orifice, said second orifice positioned so as to be aligned with said fluid inlet when said spool is in said cleaning position, the third orifice positioned to be aligned with said fluid outlet when said spool is in said cleaning position.

4. The sprayer head claimed in claim 3, including first sealing means located in the wall of said longitudinal aperture in said housing for sealing said first orifice when said spool is in said cleaning position and second sealing means located in the wall of said housing for sealing said third orifice when said spool is in said spraying position.

5. The sprayer head claimed in claim 4, wherein each of said first and second sealing means includes a recess formed in the wall of said longitudinal aperture, a seal element mounted in said recess and a pressing means for pressing said seal means toward said spool.

6. The sprayer head claimed in claim 5, wherein:

said seal means comprises a flat plate; and said pressing means comprises a resilient means position in said recess for pressing said flat plate against said spool.

7. The sprayer head claimed in claim 6, wherein said flat plate has a hole.

8. The sprayer head claimed in claim 7, wherein said resilient means comprises an O-ring.

9. The sprayer claimed in claim 4, wherein said cavity is comprised of a transverse branch extending between said second orifice and said third orifice and an L-shaped branch extending from said first orifice to said transverse branch.

10. The sprayer head claimed in claim 9, wherein said fluid inlet, said transverse branch of said cavity, and said fluid outlet are coaxially aligned when said sprayer is in said cleaning position.

11. The sprayer head claimed in claim 10, wherein each of said first and second sealing means includes a recess formed in the wall of said longitudinal aperture, a seal element mounted in said recess and a pressing means for pressing said seal means toward said spool.

12. The sprayer head claimed in claim 11, wherein:

said seal means comprises a flat plate; and said pressing means comprises a resilient means positioned in said recess for pressing said flat plate against said spool.

13. The sprayer head claimed in claim 12, wherein said flat plate has a hole.

14. The sprayer head claimed in claim 13, wherein said resilient means comprises an O-ring.

15. The sprayer head claimed in claim 10, wherein said linear actuation means comprises a pneumatically actuated, double-acting piston, and a rod that mechanically links said spool to said piston.

16. The sprayer head claimed in claim 15, wherein each of said first and second sealing means includes a recess formed in the wall of said longitudinal aperture, a seal element mounted in said recess and a pressing means for pressing said seal means toward said spool.

17. The sprayer head claimed in claim 16, wherein:

said seal means comprises a flat plate; and said pressing means comprises a resilient means position in said recess for pressing said flat plate against said spool.

18. The sprayer head claimed in claim 17, wherein said flat plate has a hole.

19. The sprayer head claimed in claim 18, wherein said resilient means comprises an O-ring.

* * * * *

UNITED STATES PATENT AND TRADEMARK OFFICE

CERTIFICATE OF CORRECTION

PATENT NO. : 4,676,435

DATED : June 30, 1987

INVENTOR(S) : Nickolas B. Nesland

It is certified that error appears in the above-identified patent and that said Letters Patent is hereby corrected as shown below:

Column 2, line 56, insert --area is aired. Since the fluid used to spray is also used to clean spray-- after "spraying"

Column 3, line 4, insert --an-- before "enlarged"

Column 7, lines 5 and 6, "position" should be --positioned--

Column 7, line 12, insert --head-- after "sprayer"

Column 8, lines 20 and 21, "position" should be --positioned--

Signed and Sealed this

Third Day of November, 1987

*Attest:*

DONALD J. QUIGG

*Attesting Officer*

*Commissioner of Patents and Trademarks*